United States Patent [19]

Lowrance

[11] Patent Number: 4,497,404

[45] Date of Patent: Feb. 5, 1985

[54] PROTECTIVE DEVICE FOR A GOLF CLUB

[76] Inventor: William T. Lowrance, 74 LeCline Cir., Concord, N.C. 28025

[21] Appl. No.: 537,782

[22] Filed: Sep. 30, 1983

[51] Int. Cl.[3] ..... A63B 57/00; B65D 85/20

[52] U.S. Cl. ..... 206/315.2; 150/52 G

[58] Field of Search ..... 150/52 G; 206/315.2, 206/315.3, 315.4, 315.6

[56] References Cited

U.S. PATENT DOCUMENTS

| | | | |
|---|---|---|---|
| 1,442,906 | 1/1923 | Rawlings et al. | 206/315.4 |
| 1,563,816 | 12/1925 | Worthington | 206/315.2 |
| 2,526,985 | 10/1950 | Whitehead | 150/52 G |
| 2,879,819 | 3/1959 | Turnbull | 150/52 G |
| 3,253,628 | 5/1966 | Koetting | 150/52 G |
| 3,492,746 | 2/1970 | Hauck | 150/52 G X |
| 3,548,908 | 12/1970 | Koetting | 150/52 G |
| 3,727,659 | 4/1973 | Shuford | 150/52 G |
| 4,195,677 | 4/1980 | Hagg et al. | 150/52 G |

FOREIGN PATENT DOCUMENTS

| | | | |
|---|---|---|---|
| 124043 | 4/1947 | Australia | 206/315.6 |
| 2452 | of 1911 | United Kingdom | 206/315.3 |
| 527306 | 10/1940 | United Kingdom | 206/315.3 |

*Primary Examiner*—William Price
*Assistant Examiner*—Sue A. Weaver

[57] ABSTRACT

This protective device is particularly designed to cover such golf clubs known as woods. Primarily, it consists of a plastic sleeve, which encases the shaft and handle grip of a club. It further includes a club head cover of knit and rubber material, which is retained on the upper portion of the sleeve.

6 Claims, 8 Drawing Figures

FIG. 1
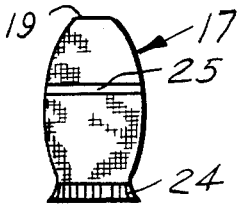
FIG. 2
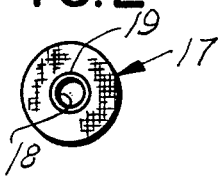
FIG. 4
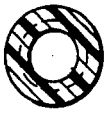
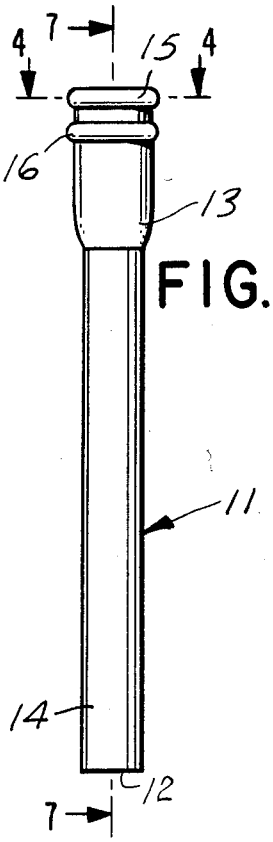
FIG. 3
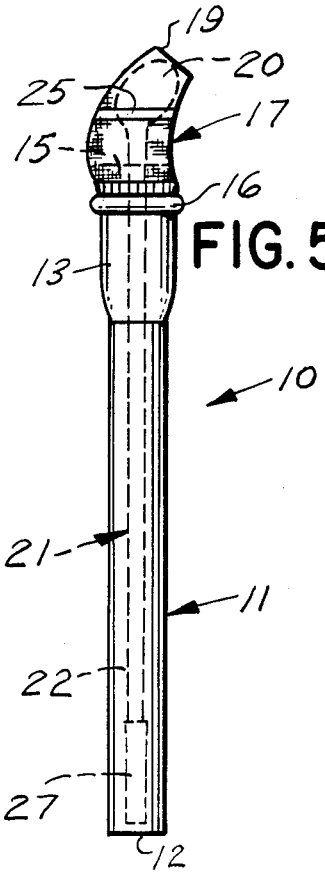
FIG. 5
FIG. 6
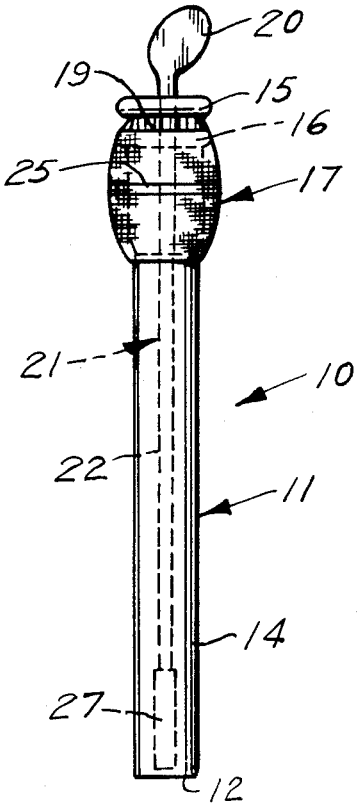
FIG. 7
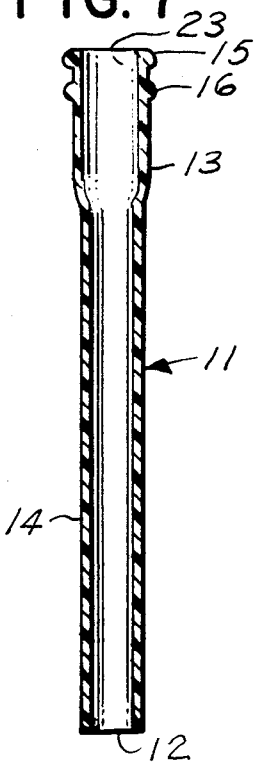
FIG. 8
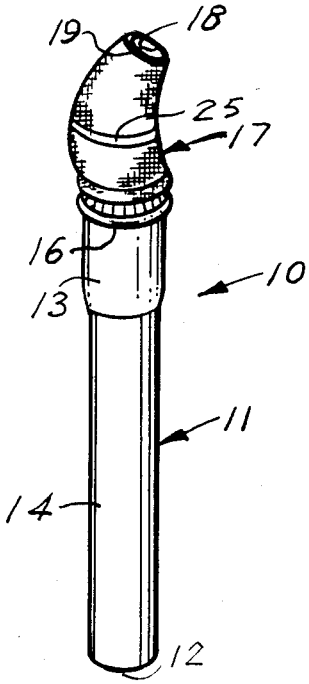

PROTECTIVE DEVICE FOR A GOLF CLUB

This invention relates to golf accessories, and more particularly, to a protective device for a golf club.

The principal object of this invention is to provide a protective device for a golf club, which will be a vast improvement over such devices of the prior art.

It has been observed, over the years, that golfers always have trouble with the head covers available for their clubs commonly known as woods. Many of these covers, or devices, are lost, some are found, and many are never found, and as these covers are purchased in sets, one cover being lost causes a golfer to have to purchase a complete new set of covers.

In addition to the abovementioned, covers of plastic are difficult to put on and take off a club, and, if they are tied together to prevent their loss, they get tangled up, and create a real nuisance. Knitted covers are easier to put on and take off, but are even worse when they become tangled together.

Another object of this invention is to provide a protective device for a golf club, which will not become an irritating part of playing golf, and will enable the golfer to stay calm and collected, as he should be, because playing golf requires a great deal of concentration and patience, without any annoyances.

Another object of this invention is to provide a protective device for a golf club, which will be of such design, as to protect the entire club, including the shaft and grip thereof.

A further object of this invention is to provide a protective device for a golf club, which will be of such structure, that it will not become lost, as those of the prior art often do.

Other objects are to provide a protective device for a golf club, which is simple in design, inexpensive to manufacture, rugged in construction, easy to use, and efficient in operation.

These, and other objects, will be readily evident, upon a study of the following specification, and the accompanying drawing, wherein:

FIG. 1 is a vertical elevational view of a golf club head cover, shown removed from the assembly;

FIG. 2 is a top plan view of FIG. 1;

FIG. 3 is a vertical elevational view of the sleeve portion of the assembly;

FIG. 4 is a transverse view, taken along the line 4—4 of FIG. 3;

FIG. 5 is a vertical elevational view of the present invention, showing a golf club in dash lines therein;

FIG. 6 is similar to FIG. 5, illustrating the head of the club exposed;

FIG. 7 is a cross-sectional view, taken along the line 7—7 of FIG. 3, and FIG. 8 is a perspective view of the present invention.

Accordingly, a device 10 is shown to include an elongated plastic sleeve 11, having an open bottom end 12. The upper end portion 13, of sleeve 11, is slightly larger in diameter than the bottom portion 14, and includes a pair of spaced-apart and annular ring portions 15 and 16, for a purpose which hereinafter will be described. A head cover 17 is provided, which is knitted material, and includes an opening 18 in its top portion 19, for the head 20 of golf club 21 to extend, when desired. The shaft 22 of club 21 is freely and slideably received within the opening 23 of sleeve 11, and head cover 17 includes an elastic rubber ring 24. The rubber ring 24 is furnished; however, it is not secured to cover 17. Head cover 17 also includes an annular and colored stripe 25 on its outer periphery, so as to be used to identify the type of golf club that is covered by device 10. The colored stripe 25 may be of any suitable color, and may be used in plurality, so as to enable the user to readily identify the club 21 he or she wishes to use. One stripe 25 serves to identify a number one wood, two stripes 25 serve to identify a number two wood, and three stripes 25 serve to identify a number three wood, etc.

The annular rings 15 and 16, of sleeve 11, are integrally attached to sleeve 11, and provide retaining means for cover 17, by receiving the elastic rubber ring 24, therebetween.

In use, the shaft 22, and handle grip 27 of club 21 are placed in the opening 23 of sleeve 11, which leaves the head 20 of club 21 exposed above the ring 15, so as to be grasped by the user, to remove club 21 from its protective sleeve 11. The head cover 17, in the above described condition, is then pulled upward over the head 20, so as to cover head 20 protectively.

When it is desired to remove golf club 21, the head cover 17 is grasped and forced downward, until the head 20 of the club 21 is exposed above the ring 15, and cover 17 is retained in between the rings 15 and 16 of the sleeve 11. The head 20 of the club 21 is then grasped by the user, to remove the club shaft 26 and grip 27 from within the sleeve 11 of device 10.

While various changes may be made in the detail construction, it is understood that such changes will be within the spirit and scope of the present invention, as is defined by the appended claims.

What I now claim is:

1. A protective device for completely enclosing a golf club, comprising, in combination, a sleeve having an opening at the upper end thereof for receiving a shaft and grip of said club, a cover open at both ends for receiving a head of the club, and means for attaching one end of said cover adjacent the opening of said sleeve, said sleeve including a pair of spaced-apart annular rings with one of said rings being located adjacent the peripheral edge of said sleeve opening and both rings defining a channel for receiving one end of said cover and said attaching means, said cover being made of an expandable material enabling it to be inverted over said sleeve with said one end being held by said attaching means and the other end being located below the other one of said rings.

2. The device of claim 1 wherein said sleeve includes an enlarged circumferential portion extending in length from the opening to the end of the cover in the inverted position.

3. The device of claim 2 wherein the other end of said cover is located below said enlarged circumferential portion when said cover is in an inverted position.

4. The device of claim 1 including at least one colored stripe on said cover for identifying the club.

5. The device of claim 1 wherein said cover is knitted material.

6. The device of claim 1 wherein said attaching mean is an elastic rubber ring.

* * * * *